US008117976B2

(12) United States Patent
Tamura

(10) Patent No.: US 8,117,976 B2
(45) Date of Patent: Feb. 21, 2012

(54) HANDICRAFT NEEDLE PUNCHER, HANDICRAFT ASSISTING TOOL AND HANDICRAFT NEEDLE PUNCH SET

(75) Inventor: Masaharu Tamura, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 516 days.

(21) Appl. No.: 12/287,871

(22) Filed: Oct. 14, 2008

(65) Prior Publication Data

US 2009/0101052 A1 Apr. 23, 2009

(30) Foreign Application Priority Data

Oct. 19, 2007 (JP) ..... 2007-272495

(51) Int. Cl.
*D05B 35/00* (2006.01)
*D05B 85/00* (2006.01)
*G09B 19/20* (2006.01)

(52) U.S. Cl. ..... 112/104; 112/226; 33/565; 434/95

(58) Field of Classification Search ..... 112/439–441, 112/48, 49, 104, 80.01, 80.4, 475.08; 223/102–104; 33/1 G, 11–13, 562–566
See application file for complete search history.

(56) References Cited

U.S. PATENT DOCUMENTS 2,574,064 A * 11/1951 Rosen ..... 434/95
2,986,390 A * 5/1961 Kelly ..... 269/2
3,240,176 A * 3/1966 Morrison ..... 112/475.18
3,444,017 A * 5/1969 Kleinermanns ..... 156/72
3,763,806 A * 10/1973 Shuffield ..... 112/226
4,026,030 A * 5/1977 Kuever et al. ..... 33/565
4,608,939 A * 9/1986 Lampley ..... 112/260
5,105,551 A * 4/1992 McCutchen et al. ..... 335/63
5,363,561 A * 11/1994 Essary ..... 33/562
7,383,640 B2 * 6/2008 Barry ..... 33/562
2003/0188675 A1 * 10/2003 Valeriote et al. ..... 112/117
2005/0166414 A1 * 8/2005 Lum et al. ..... 33/550
2011/0162510 A1 * 7/2011 Copeland ..... 84/421

FOREIGN PATENT DOCUMENTS

JP 2004-308046 11/2004

* cited by examiner

*Primary Examiner* — Ismel Izaguirre

(74) *Attorney, Agent, or Firm* — Hamre, Schumann, Mueller & Larson, P.C.

(57) ABSTRACT

A handicraft needle punch set includes a needle puncher, and an assisting tool used in performing needle punching to an object. The assisting tool includes a plurality of tubular template portions each having a desired sectional shape. The needle puncher includes a plurality of needles, a grip member supporting the needles in a manner allowing the tips of the needles to protrude to the outside, and a tubular attachment member detachably attached to the grip member. The tubular attachment member is configured to surround the needles in a noncontact manner and have a contact end portion coming into contact with the upper portions of the tubular template portions.

8 Claims, 7 Drawing Sheets

HANDICRAFT NEEDLE PUNCHER, HANDICRAFT ASSISTING TOOL AND HANDICRAFT NEEDLE PUNCH SET

BACKGROUND OF THE INVENTION

1. Field of the Invention

The present invention relates to a handicraft needle punch set used suitably in the field of handicrafts such as appliqué, where the needle punch set comprises a needle puncher and an assisting tool.

2. Description of the Related Art

Needle punching technique is employed typically in the manufacture of nonwoven cloth. In this technique, a plurality of webs made of fibers are first placed one after another and then, a needle is stuck through these webs so fibers from different webs will tangle with each other to put all of the webs into a single piece. Such a needle punching technique is used not only in the manufacture of nonwoven cloth but also in the field of felt art, for example, and proposals are made for needle punching tools, including one shown in JP-A-2004-308046, which comprises a plurality of needles attached to a grip member.

When the needle punching technique is used, first, a piece of felt which has a desired shape as a motif is placed on an appropriate sheet of cloth for example, and then, the needle is stuck through these cloth and felt a number of times, so that fibers of the felt will tangle with the fibers of the cloth, making an appliqué of the felt piece. The above mentioned JP document also teaches a support member for supporting the piece of felt when performing the needle punching. The support member has a brush-like structure, including a large number of fibriform members standing together so that their ends will form a supporting surface for the piece of felt. Such a structure makes it possible to improve operability in the needle punching work and increases the life of the needle since the structure allows sticking of the needle into the support member with a relatively small amount of force while ensuring that the needle will not be damaged upon contact with the fibriform members.

In the above-described conventional art, pieces of felt used in the needle punching art are typically cut out of a commercially available sheet of felt. However, this has been a problem when a large number of pieces are to be used for the felt work since cutting the pieces out of the sheets is time-consuming. In addition, after the pieces have been cut out, the reminder of the sheet has no use and has to be disposed as a waste, resulting in wasteful use of the resource.

SUMMARY OF THE INVENTION

The present invention has been proposed under the above-described circumstances. It is therefore an object of the present invention to provide a handicraft needle punch set which is capable of helping perform a series of operations including needle punching when making an appliqué on a piece of cloth using a needle punching technique in the art of felt work, as well as providing a handicraft needle puncher and an assisting tool which are suitable constituents of such a handicraft needle punch set.

A first aspect of the present invention provides a handicraft needle punch set that comprises a needle puncher and an assisting tool used in performing needle punching on an object. The assisting tool includes a plurality of tubular template portions each having a predetermined sectional shape. The needle puncher includes a plurality of needles, a grip member which supports the needles at a predetermined attitude so that the needles' tip portions protrude to the outside, and a tubular attachment member detachably attached to the grip member. The tubular attachment member is configured to surround the needles in a noncontact manner and have a contact tip portion coming into contact with the upper ends of the template portions.

According to the arrangement as the above, the needle puncher and the assisting tool can be used together to make an appliqué of a predetermined shape on a piece of cloth without using a piece of felt which is prepared by cutting out of a sheet. Further, since the assisting tool has a plurality of template portions, it is possible to efficiently perform a series of operations including placement of fibers in the respective template portions and needle punching.

Preferably, the assisting tool may further include an outer frame surrounding the template portions via hollow portions.

Preferably, the attachment member may become more widely open toward the tips of the needles.

Preferably, the template portions may be transparent or translucent.

A second aspect of the present invention provides a handicraft needle puncher that includes: a plurality of needles; a grip member supporting the needles so that the needles' tips protrude to the outside; and a tubular attachment member detachably attached to the grip member. The tubular attachment member has a tip serving as a contact portion coming into contact with the upper portions of the template portions.

Preferably, the needle puncher may include two or more kinds of attachment members. These attachment members may differ from each other in their dimensions measured in the axial direction of the needles when attached to the grip member.

Preferably, the needles may be detachable from the grip member.

A third aspect of the present invention provides a handicraft assisting tool used in performing needle punching to a desired object. The assisting tool includes a plurality of tubular template portions each having a predetermined sectional shape.

Preferably, the assisting tool may further include an outer frame surrounding the template portions via hollow portions which are sandwiched between the template portions and the outer frame.

Other features and advantages of the present invention will become clearer from the description given below with reference to the accompanying drawings.

DETAILED DESCRIPTION OF THE PREFERRED EMBODIMENT

Preferred embodiments of the present invention will be described below with reference to the accompanying drawings.

Figure 1:
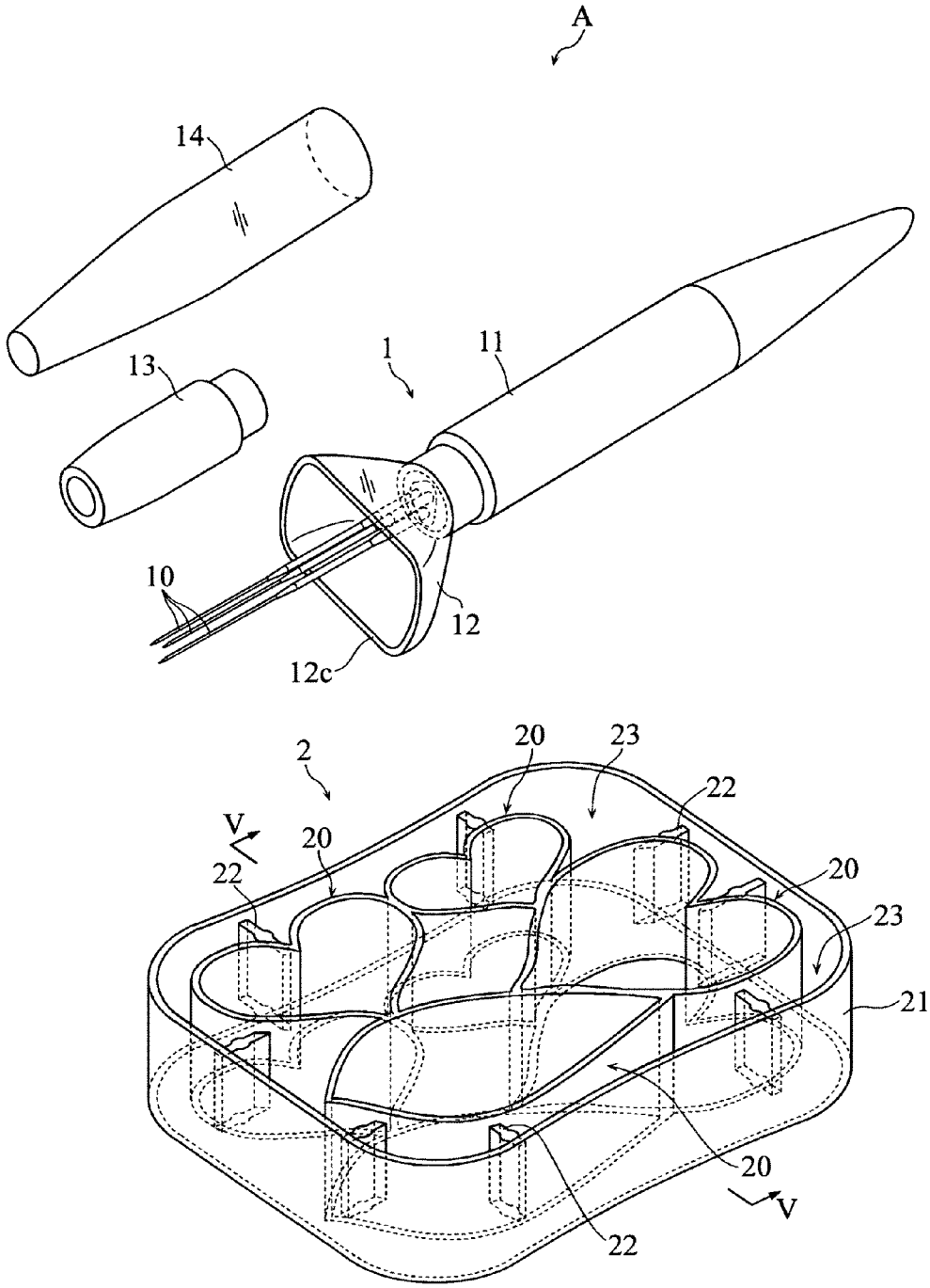
FIG. 1 is a perspective view of a handicraft needle punch set according to the present invention.

FIG. 1 shows a handicraft needle punch set according to the present invention. The illustrated needle punch set A includes a needle puncher 1 and an assisting tool 2 for needle punching operation.

Figure 2:
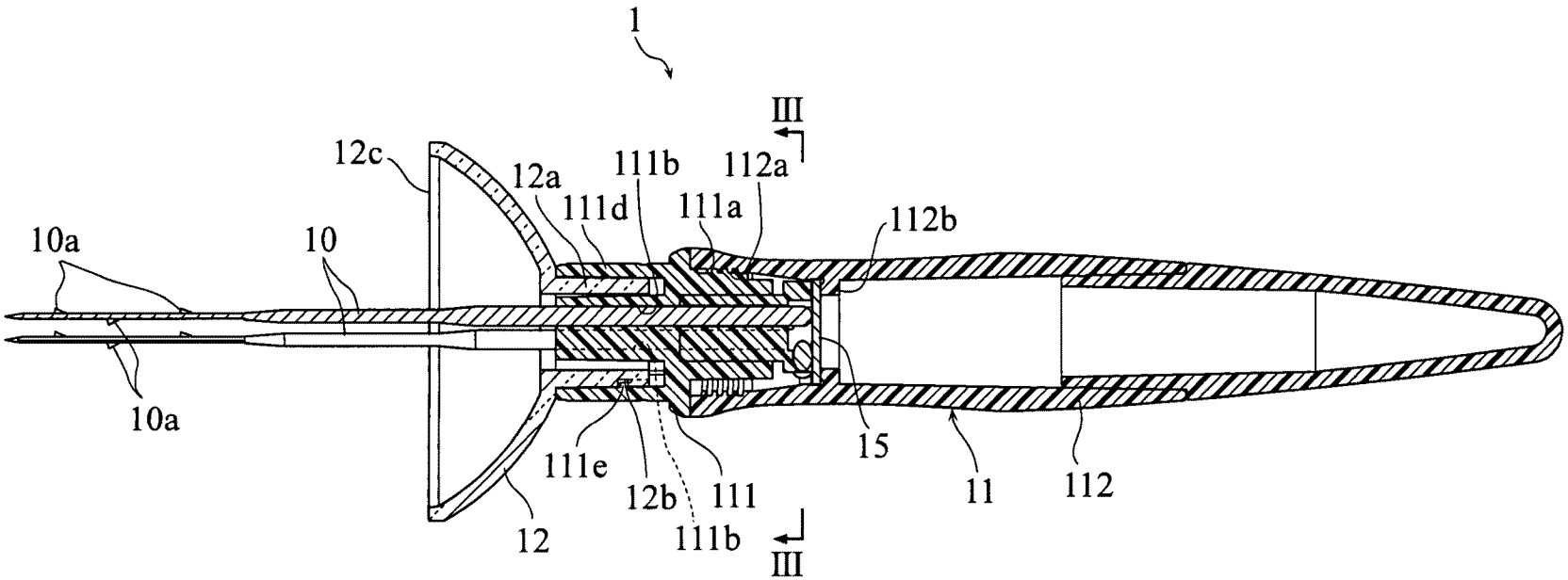
FIG. 2 is a sectional view of a needle puncher which is a constituent of the handicraft needle punch set shown in FIG. 1.

The needle puncher 1 includes a plurality (three in the illustrated example) of needles 10, a grip member 11 which holds these needles 10, an attachment member 12, a replacement attachment member 13 and a cap 14. Each of the needles 10 has its tip portion protruding from a tip end of the grip member 11. The needles 10 may be ordinary needle-punching needles employed in the manufacture of nonwoven cloth. As shown in FIG. 2, it is preferable that the needles 10 have their tip portions provided with one or more tiny hooks 10*a* called "barb" for increased effect of fiber entanglement.

The grip member 11 is made of synthetic resin for example, and has a needle holder 111 for holding the needles 10, and a grip main body 112 for the user to hold on. For the sake of user's convenience, the grip main body 112 is formed like a pen, i.e., into a tube of a relatively small diameter. The needle holder 111 and the grip main body 112 have threads 111*a*, 112*a* respectively. These threads 111*a*, 112*a* are mated with each other, thereby connecting the needle holder 111 and the grip main body 112 integrally with each other.

Figure 3:
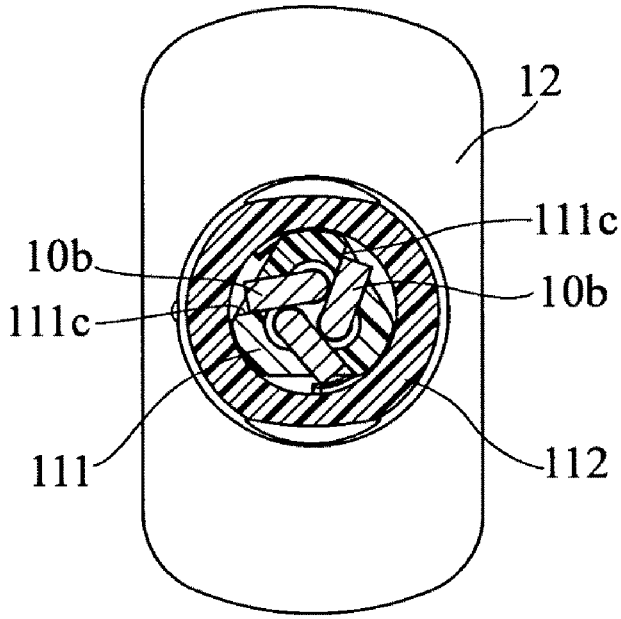
FIG. 3 is a sectional view taken along lines III-III in FIG. 2.

The needle holder 111 has a plurality of through-holes 111*b*. Each of these through-holes 111*b* is penetrated by one of the needles 10, whereby each of the needles 10 is held at a predetermined radial position. As shown clearly in FIG. 3, the needles 10 have a substantially L-shaped head 10*b*, and these bent heads 10*b* are fitted into grooves 111*c* which are formed in a base end portion of the needle holder 111. This arrangement prevents the needles 10 from coming off a tip portion 111*d* of the needle holder 111, as well as preventing the needles 10 from rotating.

As shown in FIG. 2, a stopper 112*b* is formed inside the grip main body 112. When the threads 111*a*, 112*a* are mated with each other, the stopper 112*b* holds on a small, disc-like blocking plate 15, which then holds on the base end portion of the needle holder 111, i.e. the heads 10*b* of the needles 10, toward the tip of the needle holder 111 (toward the left as in the figure). Thus, the needles 10 are prevented from moving in their axial direction. With this arrangement, each of the needles 10 is held at a predetermined attitude by the grip member 11.

It should be noted here that once the grip main body 112 is removed from the needle holder 111, the needles 10 are removable from the needle holder 111 by pulling them toward the base end side. Therefore, the needles 10 can be easily and appropriately replaced with new ones if any of the needles 10 are damaged or broken. Further, the number of the needles 10 can be changed easily, by removing any desired ones of the needles 10.

As shown in FIG. 1 and FIG. 2, the attachment member 12 is generally tubular, and attached to the tip portion 111*d* of the needle holder 111 so as to surround the needles 10 in a noncontact manner. Specifically, the tip portion 111*d* of the needle holder 111 has a tubular opening, and the attachment member 12 has a tubular base end 12*a* inserted into the tip portion 111*d*. A tab 111*e* is formed on the inner surface of the tip portion 111*d* whereas a substantially L-shaped groove 12*b* engagable by the tab 111*e* is formed on the outer surface of the base end 12*a*.

Figure 4:
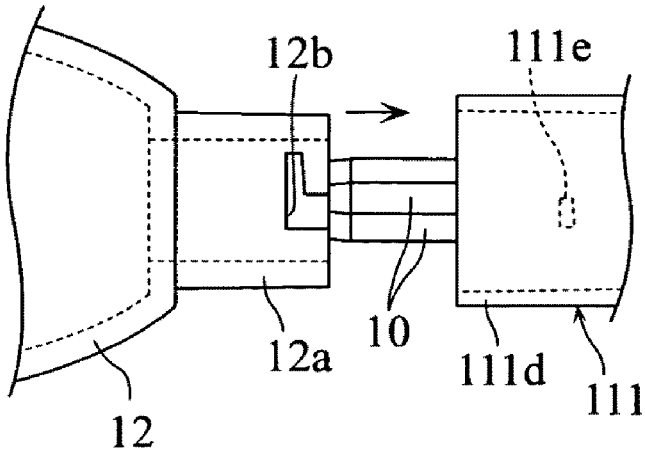
FIG. 4 shows how an attachment member, which is a constituent of the needle puncher shown in FIG. 2, is attached.

When attaching the attachment member 12 to the needle holder 111, first, the attachment member 12 is brought closely to the needle holder 111 as shown in FIG. 4, axially of the needles 10. Then, after the tab 111*e* has passed the edge of the groove 12*b*, the attachment member 12 is rotated about its axis, relatively to the needle holder 111 until the tab 111*e* is positioned deeply in the groove 12*b*. Under this state, the attachment member 12 is not movable, in the axial direction with respect to the needle holder 111. When removing the attachment member 12, the procedure is performed in the reverse order. With such an arrangement, the attachment member 12 is detachably attached to the needle holder 111 (the grip member 11).

As shown in FIG. 1 and FIG. 2, the attachment member 12 becomes more widely open (in other words, flares) as it is closer to the tips of the needles 10. More specifically, the size of the opening increases in the direction which is perpendicular to the axial direction of the needles 10. The attachment member 12 has a tip edge that lies in a substantially flat plane and functions as a contact portion 12*c* coming into contact with the upper edges of the respective template portions 20 of the assisting tool 2.

As shown in FIG. 1, the replacement attachment member 13 is tubular, and is used when tangling a piece of felt with a piece of cloth as will be described later. The replacement attachment member 13 has a base end side formed with a groove (not illustrated) similarly to the groove 12*b* of the attachment member 12. With this arrangement, the replacement attachment member 13 is attached to the grip member 11, using the same method as for the attachment member 12, in a detachable manner. When attached, the replacement attachment member 13 has a length, i.e. a dimension axially of the needles 10, longer than the comparable dimension of the attachment member 12.

The cap 14, which covers and protects the tip portions of the needles 10 when the needle puncher 1 is not in use, is detachably fitted to the tip portions of the grip member 11. The cap 14 is made of a transparent synthetic resin for example.

Figure 5:
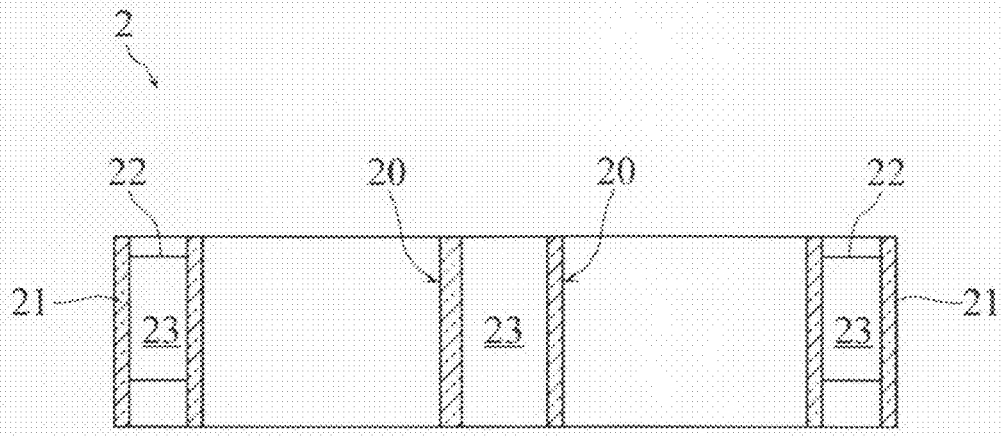
FIG. 5 shows an assisting tool, which is a constituent of the handicraft needle punch set shown in FIG. 1, in a sectional view taken along lines V-V in FIG. 1.

As shown in FIG. 1 and FIG. 5, the assisting tool 2 is a single piece of transparent or translucent synthetic resin, and includes a plurality of template portions 20 and an outer frame 21 which is connected with the template portions 20 via joints 22. Each of the template portions 20 is tubular and has a predetermined cross-sectional shape formed by its wall. The space inside each template portion 20 will be filled with fibers when performing a needle punching operation. The cross-sectional shape of the template portion 20 represents the shape to be formed by the needle punching operation. In the present embodiment, three heart patterns and one tree leave pattern make up the template portions.

The outer frame 21 is on the outside of the template portions 20, as a tube made of a wall to surround the template portions 20. Hollow portions 23 are provided between the outer frame 21 and the template portions 20. The outer frame 21 and the template portions 20 have substantially the same height, and their upper ends are substantially flush with each other as are their lower ends.

Next, how to use the handicraft needle punch set A and the workings thereof will be described.

Figure 6:
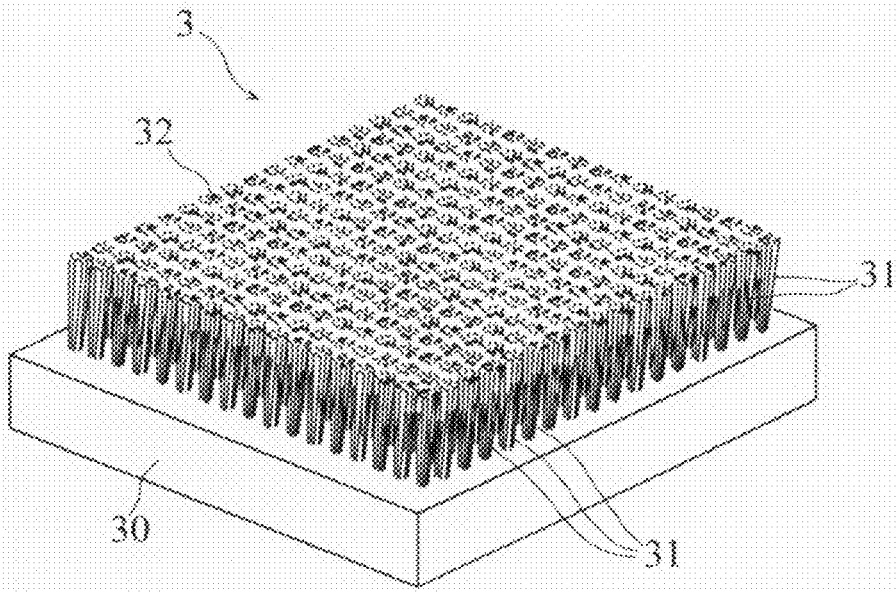
FIG. 6 is a perspective view of a support member which is used together with the handicraft needle punch set shown in FIG. 1.

When performing needle punching with the needle punch set A, it is preferable to use a support member upon which a piece of object cloth (to which the needle punching is to be made) is placed. FIG. 6 shows a support block 3 as an example of such a support member. Specifically, the support block 3 has a brush-like structure, including a platy rectangular base block 30, and a large number of upright fibriform members 31 planted into the top surface of the support block 3. The fibriform members 31 have their tips substantially within the same plane, providing a substantially flat support surface 32 for supporting the object cloth. The support block 3 may be provided by a commercially available product used as a clothes brush for example.

Figure 7:
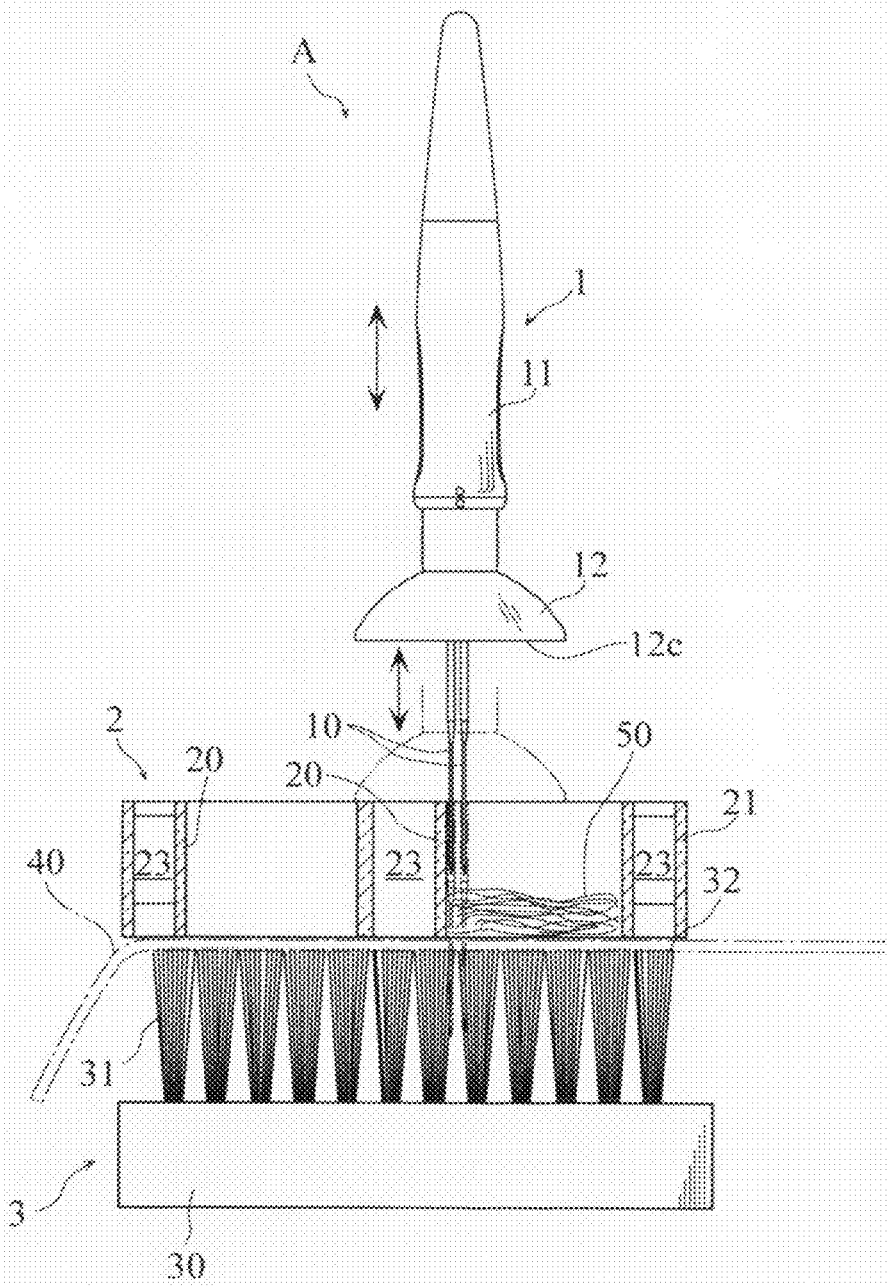
FIG. 7 is a sectional view, showing a state where the handicraft needle punch set shown in FIG. 1 is in use.

The needle punch set A and the support block 3 may be used in the following manner to make an appliqué on a piece of cloth. First, as shown in FIG. 7, a piece of cloth 40 and then the assisting tool 2 are placed on the support surface 32 of the support block 3. Subsequently, an appropriate amount of fibers 50 is placed in the inside space of a template portion 20 of the assisting tool 2.

With the needle puncher 1 held by a hand and moved downward, the needles 10 are stuck through the fibers 50 inside the template portion 20 and through the cloth 40. This sticking procedure may be repeated evenly over the entire area of the inside space of the template portion 20. In the downward sticking procedure, the contact portion 12*c* at the tip portion of the attachment member 12 in the needle puncher 1 comes into contact with the upper edge of the template portion 20, thereby limiting the movement of the needle puncher 1 toward the support block 3. It is designed so that the tips of the needles 10 will not reach the base block 30 of the support block 3 by the limiting engagement between the attachment member 12 and the template portion 20. It should be noted here that since the assisting tool 2 is transparent or translucent, it is possible to check the conditions of the fibers 50 in the inside space of the template portion 20 during the sticking procedure.

As the sticking procedure is repeated, the fibers 50 are tangled with fibers of the cloth 40, into a piece of felt, forming an appliqué which is patterned in accordance with the cross-sectional shape of the template portion 20.

As described, use of the needle punch set A of the present embodiment makes it possible to create an appliqué of a predetermined pattern on a piece of cloth 40 without using a piece of felt which is cut out of a sheet. The fibers to be placed in the template portion 20 may be of any desired color, kind or volume. Therefore, the present method makes it possible to eliminate wasteful use of the material as compared to cases where an appliqué is made with a cut piece of felt.

As described above, the attachment member 12 attached to the needle puncher 1 is configured to become wider toward the tips of the needles 10. This ensures that during the sticking procedure the contact portion 12*c* of the attachment member 12 makes appropriate contact with the upper edge of the template portion 20.

In addition, since the attachment member 12 becomes wider toward the tip portion, it is possible, as shown in FIG. 7, to move the needles 10 closely along the inner wall surface of the template portion 20 when sticking areas along the inner edge of the template portion 20. This allows the needles 10 to be moved vertically to the cloth 40 over the entire area in the inside space of the template portion 20, ensuring that the appliqué made on the cloth is steady and uniform.

In the present embodiment, the assisting tool 2 has hollow portions 23 sandwiched between the template portions 20 and the outer frame 21 which surrounds the template portions 20. This arrangement allows the needles 10 to pass through the hollow portion 23 in case the needles 10 miss the template portion 20 during the sticking procedure with the needle puncher 1. Therefore, the arrangement reduces such a problem that the tip of a needle 10 unduly hits the assisting tool 2 and is damaged. In this connection, the template portions 20 may preferably have a rounded upper edge. As a result, the tip of the needle 10 which unduly hits the upper edge of the template portion 20 is more likely to be guided by the inner wall of the template portion 20 or by the hollow portion 23, whereby damage to the needles 10 can be prevented.

Figure 8:
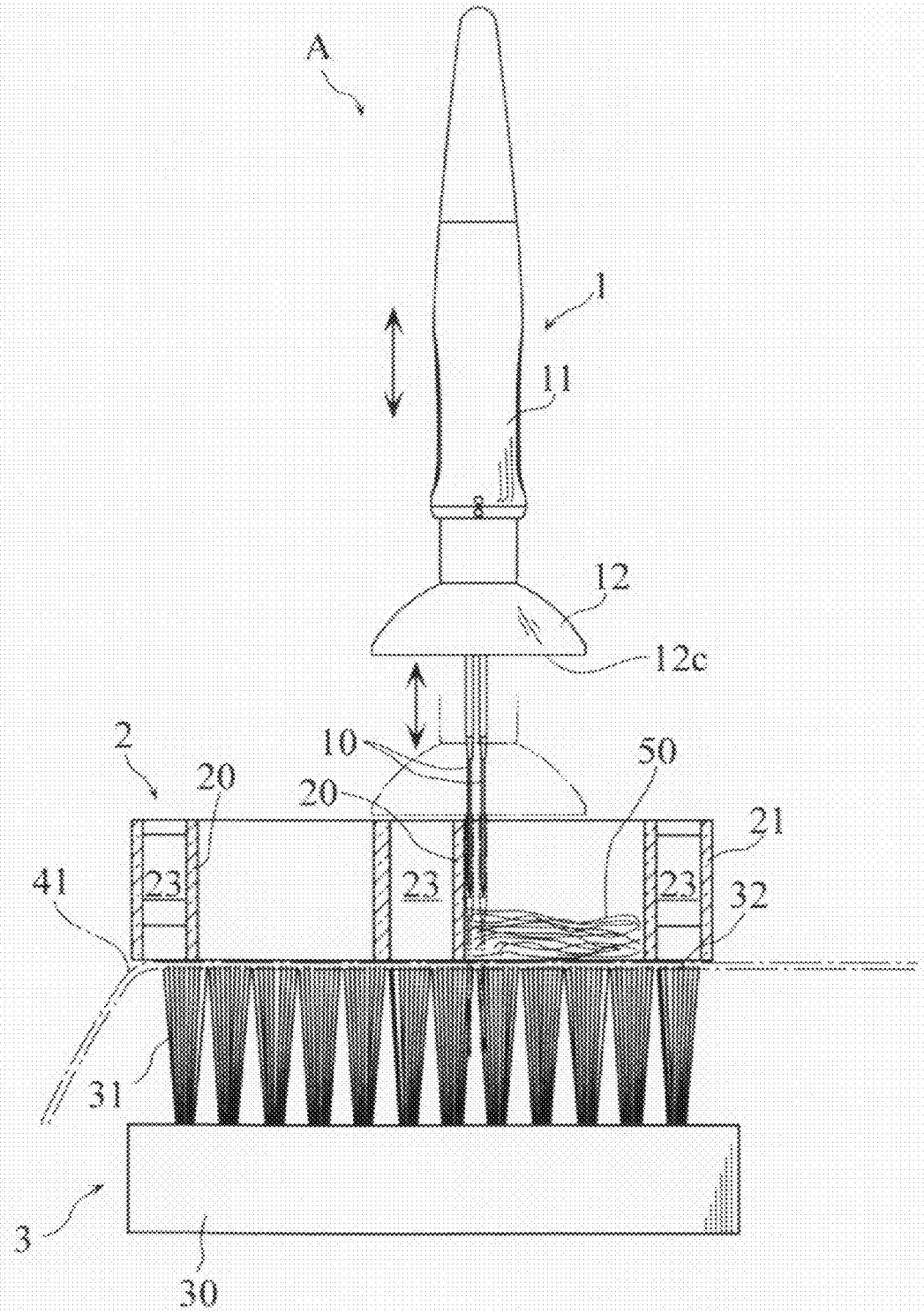
FIG. 8 is a sectional view, showing another state where the handicraft needle punch set shown in FIG. 1 is in use.

Next, description will be made for a method of making a motif of felt from fibers, using the needle punch set A and the support block 3. First, as shown in FIG. 8, a partition member 41 and then the assisting tool 2 are placed on the support surface 32 of the support block 3. Subsequently, an appropriate amount of fibers 50 is placed in the inside space of a template portion 20 of the assisting tool 2. The partition member 41 is placed between the support surface 32 and the assisting tool 2 for preventing the fibers 50 from being tangled with the fibriform members 31 of the support block 3. The partition member 41 is preferably of a non-expandable material that can be easily penetrated by the tips of the needles 10 so as not to disturb the sticking procedure performed with the needle puncher 1. A good example of the suitable partition member is a certain kind of paper such as photocopying paper.

Then, with the needle puncher 1 held by a hand and moved downward, the needles 10 are stuck through the fibers 50 and the partition member 41. This sticking procedure is repeated evenly over the entire area in the inside of the template portion 20. In the sticking procedure, the fibers 50 are tangled together (partially with the partition member 41) to form into a piece of felt. Then, the partition member 41 is removed from the felt piece, to provide a motif that is patterned in accordance with the cross-sectional shape of the template portion 20. A further procedure may be employed for neatly finishing the shape of the motif. Specifically, both the motif and the assisting tool 2 are turned over, then the motif is reset into the same template portion 20 of the assisting tool 2, and the sticking procedure is performed again with the use of a new partition member 41.

Next, description will be made for a method of making an appliqué of a "felt piece" on a piece of cloth. Here, the "felt piece refers to a fiber aggregation keeping an appropriately stable shape, such as a piece cut out of a sheet of felt, a motif obtained by the above described method, wool yarn, and so on. In this case, the needle puncher 1 and the support block 3 are to be used, while the assisting tool 2 is not. Also, in place of the attachment member 12, the replacement attachment member 13 is attached to the needle puncher 1.

Figure 9:
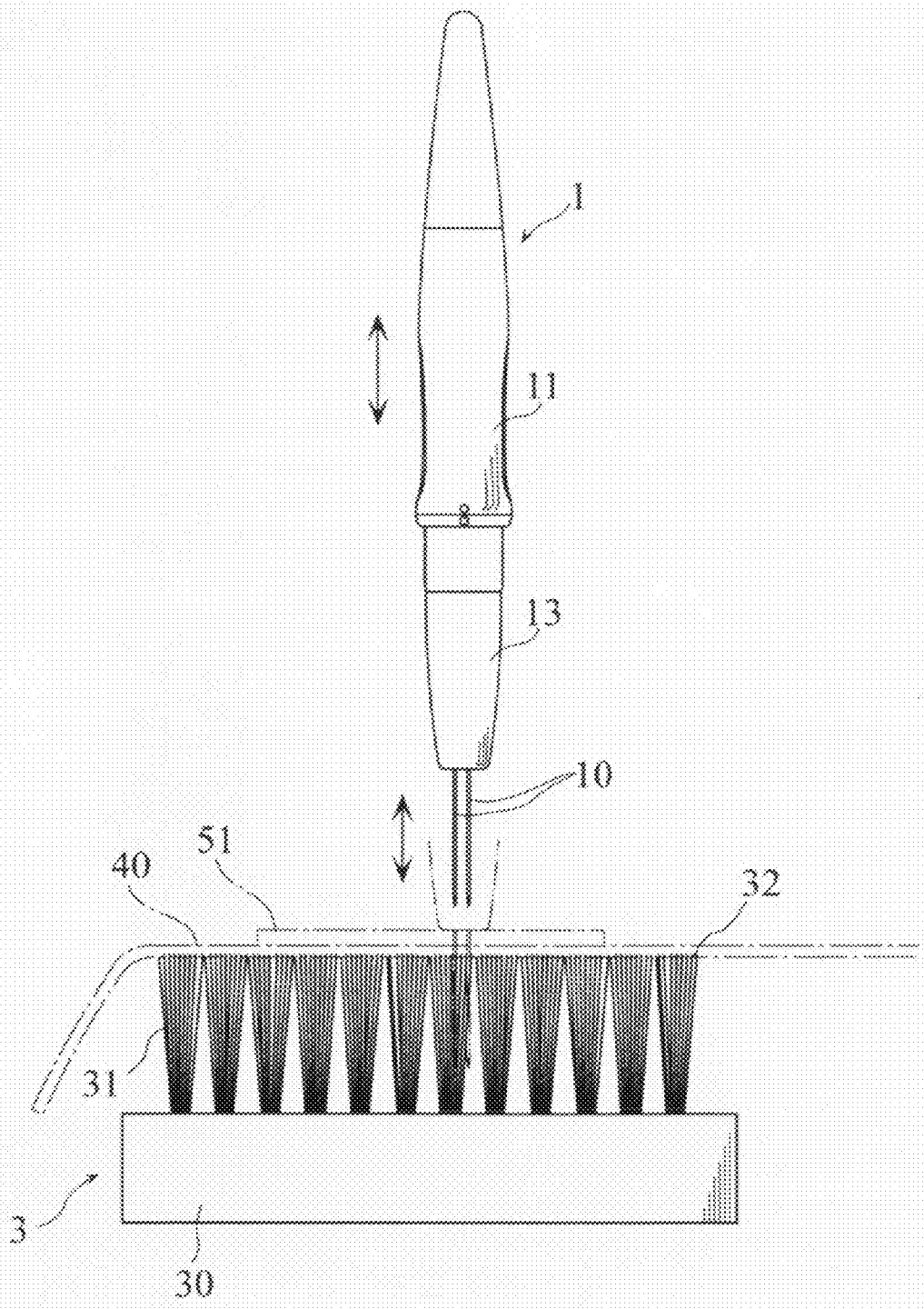
FIG. 9 is a sectional view, showing a state where the needle puncher shown in FIG. 2 is in use.

First, as shown in FIG. 9, a piece of felt 51 placed on a piece of cloth 40 is set on the support surface 32 of the support block 3. Then, with the needle puncher 1 held by a hand and moved downward, the needles 10 are stuck through the felt 51 and the cloth 40. This sticking procedure is repeated. With this sticking procedure, the fibers of the felt 51 are tangled with the fibers of the cloth 40, making the piece of felt 51 fixed to the cloth 40, forming an appliqué on the cloth 40.

As mentioned above, the length of the replacement attachment member 13 (i.e. its dimension measured axially of the needles 10) is longer than that of the attachment member 12. Therefore, the needles 10 protrude from the grip member 11 to a smaller degree than when the attachment member 12 is used. With this arrangement, the tips of the needles 10 are prevented from reaching the base block 30 of the support block 3 during the sticking procedure.

As described, the needle puncher 1 is also suitable for procedures of making an appliqué by tangling a piece of felt 51 with a piece of cloth 40. Also, differing from the above-described embodiments, the needle puncher 1 can be used without any attachment member attached to the grip member

11. In this case, the needles 10 protrude from the grip member 11 to a greater degree, which makes it easy to stitch an appliqué to a three-dimensional object such as a stuffed animal.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

The invention claimed is:

1. A handicraft needle punch set, comprising:

a needle puncher; and an assisting tool used in performing needle punching to an object;

wherein the assisting tool includes a plurality of tubular template portions each having a predetermined sectional shape;

wherein the needle puncher includes a plurality of needles, a grip member supporting the needles in a manner allowing tips of the needles to protrude to an outside, and a tubular attachment member detachably attached to the grip member, the tubular attachment member being configured to surround the needles in a noncontact manner and have a contact end portion coming into contact with upper portions of the tubular template portions.

2. The handicraft needle punch set according to claim 1, wherein the attachment member flares toward tips of the needles.

3. The handicraft needle punch set according to claim 1, wherein the template portions are transparent or translucent.

4. A handicraft needle puncher, comprising:

a plurality of needles each including a barb;

a grip member including a tip end and a rear end opposite the tip end, the tip end supporting the needles in a manner allowing tips of the needles to protrude to an outside; and a tubular attachment member detachably attached to the tip end of the grip member and configured to surround the needles in a noncontact manner, the tips of the needles always protruding beyond the tubular attachment member while the tubular attachment member is held attached to the grip member, wherein the grip member further includes an outer gripping surface that extends from the tip end toward the rear end and is exposed for manual gripping.

5. The handicraft needle puncher according to claim 4, wherein the attachment member flares toward tips of the needles.

6. The handicraft needle puncher according to claim 4, wherein the needles are detachably attached to the grip member.

7. A handicraft assisting tool used for needle punching, comprising:

a plurality of tubular template portions each having a predetermined sectional shape or size that differs from the sectional shape or size of any other template portion; and a frame in which the plurality of tubular template portions are arranged, the tubular template portions being spaced from the frame and connected thereto via a plurality of joints.

8. The handicraft assisting tool according to claim 7, wherein the template portions are transparent or translucent.

* * * * *